US009303465B2

(12) United States Patent
Pare et al.

(10) Patent No.: US 9,303,465 B2
(45) Date of Patent: Apr. 5, 2016

(54) RELEASABLY LOCKABLE, RETRIEVABLE, MULE SHOE ASSEMBLY

(75) Inventors: Quentin Pare, Calgary (CA); Adrien Fortunato, Calgary (CA)

(73) Assignee: HPC ENERGY TECHNOLOGIES LTD., Calgary (CA)

( * ) Notice: Subject to any disclaimer, the term of this patent is extended or adjusted under 35 U.S.C. 154(b) by 449 days.

(21) Appl. No.: 13/312,740

(22) Filed: Dec. 6, 2011

(65) Prior Publication Data

US 2013/0140019 A1 Jun. 6, 2013

(51) Int. Cl.
*E21B 7/06* (2006.01)
*E21B 17/06* (2006.01)

(52) U.S. Cl.
CPC ..... *E21B 17/06* (2013.01)

(58) Field of Classification Search
USPC ..... 166/117.5, 380, 117.6, 242.1; 175/77, 175/78, 79, 61
See application file for complete search history.

(56) References Cited

U.S. PATENT DOCUMENTS 4,130,162 A * 12/1978 Nelson ..... 166/243
4,236,734 A * 12/1980 Ahangarzadeh ..... 285/26
5,615,740 A 4/1997 Comeau et al.
6,053,254 A * 4/2000 Gano ..... 166/384
6,568,480 B2 * 5/2003 Dewey ..... 166/382
2008/0110673 A1 * 5/2008 Giroux et al. ..... 175/5

OTHER PUBLICATIONS

Canadian Patent Office, Office Action in corresponding Canadian Patent Application No. 2,760,931, dated Sep. 12, 2013.

* cited by examiner

*Primary Examiner* — Taras P Bemko
(74) *Attorney, Agent, or Firm* — Kenyon & Kenyon LLP

(57) ABSTRACT

A mule shoe assembly for use in directional drilling which advantageously has releasable locking means to free the directional orienting tool from engagement with the outer mule shoe in situations where the drill bit may become stuck. The releasable locking means comprises a moveable pin which engages an aperture. A first configuration utilizes detent means and spring biasing of the pin. In a second configuration, the pin is adapted for locking engagement by pressurized downhole drilling mud, and may be disengaged from the aperture when pressure from drilling mud ceases. In a preferred embodiment the pin both has detent means and is spring biased, and also relies on drilling mud pressure to remain in locking engagement. The pin may be disengaged upon removal of drilling mud pressure and application of a positive separation force between the directional measurement tool and associated inner tool member, and outer mule shoe member.

18 Claims, 9 Drawing Sheets

RELEASABLY LOCKABLE, RETRIEVABLE, MULE SHOE ASSEMBLY

FIELD OF THE INVENTION

The present invention relates to directional drilling tools for use in directionally drilling of oil wells, and more particularly to a retrievable directional orientation assembly.

BACKGROUND OF THE INVENTION

For directional drilling of oil and gas wells, a drill string generally has, at its distal end, a drill bit which is energized by a hydraulically-powered "mud" motor. Such drill bit and hydraulically-powered motor is generally contained in a so-called "bent sub". A universal bottom hole orienting sub assembly ("UBHO sub"), containing a directional measurement tool, is generally threadably coupled to the bent sub, uphole therefrom. The directional measurement tool within the UBHO sub contains electronic instrumentation for determining drill bit location and orientation, and together such form part of the drill string bottom hole assembly ("BHA").

The UBHO sub is adapted at its downhole end to be threadably connected to the bent sub, and at its uphole end to be threadably connected to various other bottom hole assembly components, such as mud pulser device/assembly for transmitting downhole drilling orientation information from the directional measurement tool to surface, gamma modules for determining geology of formations being drilled through, and battery-containing elements, all of which may be connected in series to each other, and to the UBHO sub at its uphole end.

The UBHO orienting sub has a hollow cylindrical outer member ('mule shoe'), typically having an arcuate camming surface on an interior surface thereof for landing against a mating arcuate camming surface on a directional measurement tool when such directional measurement tool is coaxially inserted and caused to nest within the outer mule shoe member. Specifically, the mule shoe member typically has an perpendicular aperture through the bore of the mule shoe, for receiving a key member which extends therethrough and into an axially extending channel in the directional measurement tool when the arcuate camming surfaces on the respective mule shoe member and inner directional measurement tool cause each of the aforesaid components to be rotated in a desired orientation one to another. The key member when inserted and pinned in such inserted position fixedly keeps such orientation of one to the other. A further set screw extending from the mule shoe member to the inner directional measurement tool in the prior art is then typically used to "lock" the directional measurement tool to the mule shoe and prevent the directional measurement tool from being removed from within the mule shoe member, and thereby allow the UBHO sub (containing the mule shoe and directional measurement tool locked therewithin) and the bent sub and drill bit attached thereto, to be lowered downhole so as to permit directional drilling.

Disadvantageously, if the drill bit should become stuck for some reason in the wellbore during directional drilling, which sometimes occurs at long wellbores of narrow diameter with extensive directional changes, and it then becomes impossible to withdraw the drill string intact, and typically the drill string will become pulled apart at a location above the UBHO and above the gamma module, mud pulser, and batteries when the drill string is attempted to be raised to surface. Such results in not only loss of the bent sub and mud motor (which in any event are "stuck"), but further results in loss of the UBHO sub containing the directional measurement tool, as well as various associated equipment uphole thereof up to the point at which the drill string parted, which typically includes such components as the gamma module, batteries, and various connecting members.

Loss of such UBHO sub and uphole equipment can be quite expensive. For example, in year 2011 (US) dollars, a directional module may cost in the range of $60,000 (US), a mud pulser $36,000, batteries in the range of $8-10,000 each, and a gamma module in the range of $25,000, with various interconnects costing in the range of $4000, and thus h the entire assembly costing in the range of approximately $125,000. Accordingly, loss of such UBHO sub and related assemblies/components downhole is quite expensive.

SUMMARY OF THE INVENTION

In order to avoid the problem of loss of expensive BHA equipment such as a UBHO sub downhole if and when a drill bit becomes stuck downhole, the present invention provides an improved UBHO sub assembly which is releasable and thus retrievable along with various uphole BHA components, should the drill bit become stuck within a wellbore.

Such releasably coupling of the directional tool to the outer mule shoe of a UBHO sub is accomplished by providing a releasable locking pin member to releasably couple an outer mule shoe assembly to an inner mule shoe assembly which contains the directional measurement and orienting tool. In such fashion, the inner mule shoe assembly containing the directional measurement tool may, when the locking pin member is released in one of the two manners described below, from locking engagement with the inner mule shoe, withdrawn from within the outer mule shoe and brought to surface along with any other associated BHA tools, such as the mud pulser and gamma module.

Accordingly, in a broad aspect the present invention comprises a releasably lockable, retrievable mule shoe assembly for use in a bottom hole orienting assembly for use in directional drilling, comprising:

(i) a substantially cylindrical hollow elongate outer mule shoe member, having:

(a) an arcuate camming surface around an inner periphery of said hollow shoe member thereof;

(ii) an inner cylindrical tool member, adapted to contain therewithin a directional measurement tool, and adapted for insertion within said hollow mule shoe member, having:

(b) a mating arcuate camming surface adapted for mating engagement with said camming surface on said mule shoe member;

(c) an aperture in either of said inner cylindrical member or said outer cylindrical member, for receiving therewithin a locking pin member;

(iii) said locking pin member moveable in a linear back and forth direction perpendicular to a longitudinal axis of said mule shoe member, and insertable in said aperture means for releasably coupling said mule shoe member to said directional tool member.

In a preferred embodiment the arcuate camming surface on said outer mule shoe member and said mating arcuate camming surface on said inner tool member are adapted, when landed one upon the other, to angularly position the inner cylindrical member and directional tool therewithin in a desired, fixed angular position relative to said outer mule shoe member.

The locking pin member is configured so as to releasably couple the inner tool member to the outer mule shoe member in one of three ways.

In a first configuration, the locking pin member further comprises:

a) spring means;

b) a detent member, biased by said spring means;

wherein the spring means adapted to cause the detent member to releasably engage said aperture means on said directional measurement tool, and thereby releasably couple the inner tool member (and directional tool therewithin) to the outer mule shoe member.

Specifically, in such first configuration, the locking pin member has spring-biasing means and detent means so that when the inner tool member is inserted within the outer mule shoe member, the locking pin member is biased so as to be slidably inserted within the aperture means, which aperture means is located in the inner tool member if the locking pin member is located in the outer mule shoe, and in the outer mule shoe member if the locking pin is located in the inner tool member. The detent means on the locking pin member may comprise a pin having a hemispherical end, which when the pin is extended engages the aperture, preventing removal of the inner tool member from the outer mule shoe member unless sufficient parting force is applied to cause the spring-biased pin and rounded end thereof to be withdrawn from the aperture, thereby allowing the inner tool member (and directional tool therewithin) to be withdrawing from the outer mule shoe member.

In a second configuration, pressure exerted by drilling mud on the exterior of the outer mule shoe when such assembly in inserted downhole causes or assists in causing the locking pin member to be biased in locking engagement with the aperture. In such configuration, if the drill bit becomes stuck, drilling stops and drilling mud is no longer in such circumstances forced downhole and against the exterior surface of the outer mule shoe member (and thus no longer against the locking pin member). In such circumstances the locking pin member, upon a separating force being applied as between the outer mule shoe member and the inner tool member when the inner tool member to attempted to be pulled to surface, can then be moved away from its locking position within the aperture, thereby freeing the inner tool member (and directional tool therewitihin) from locking engagement with the outer mule shoe, thereby then allowing the inner tool member to then be raised to surface.

Accordingly, in such second embodiment, the locking pin member is adapted, when said assembly is placed downhole in a well and downhole fluid pressure is exerted on an exterior surface thereof, to lockingly engage said mule shoe member to said directional tool member, and when said downhole fluid pressure is lessened or removed, is further adapted to disengage said directional tool member to allow said inner cylindrical tool member and said directional tool member to be withdrawn from within said mule shoe assembly.

In a preferred configuration, the features of the first and second configurations are combined.

Accordingly, in such preferred configuration, spring biasing means may further be provided, to bias the locking pin member in an engaged position within the aperture means, and the locking pin member further provided with detent means, so as to thereby allow the pin member to be biased in engagement with the aperture means and thus coupled engagement of the outer mule shoe member to the inner tool member, even when no pressure may be exerted against the side of the outer mule shoe member, such as when a drill string having such mule shoe assembly as a part thereof, is lowered downhole Again, however, due to the operation of the detent means (typically a hemispherical rounded edge supplied to the pin member), the inner tool member may when desired and when no pressure is exerted on the pin member by drilling fluid, be withdrawn from coupled engagement with the outer mule shoe member.

Lastly, in a third configuration of the mule shoe assembly of the present invention, the pin member is of a metal which is softer than that which comprises either the outer mule shoe and/or the inner tool. In such fashion, upon application of an upward separation force to said inner tool member and said mule shoe member, pin member may become sheared off, so as to allow separation of said inner tool member from said outer mule shoe.

BRIEF DESCRIPTION OF THE DRAWINGS

The accompanying drawings illustrate one or more exemplary embodiments of the present invention and are not to be construed as limiting the invention to these depicted embodiments.

DETAILED DESCRIPTION OF PREFERRED EMBODIMENTS

Figures 1A, 1B:
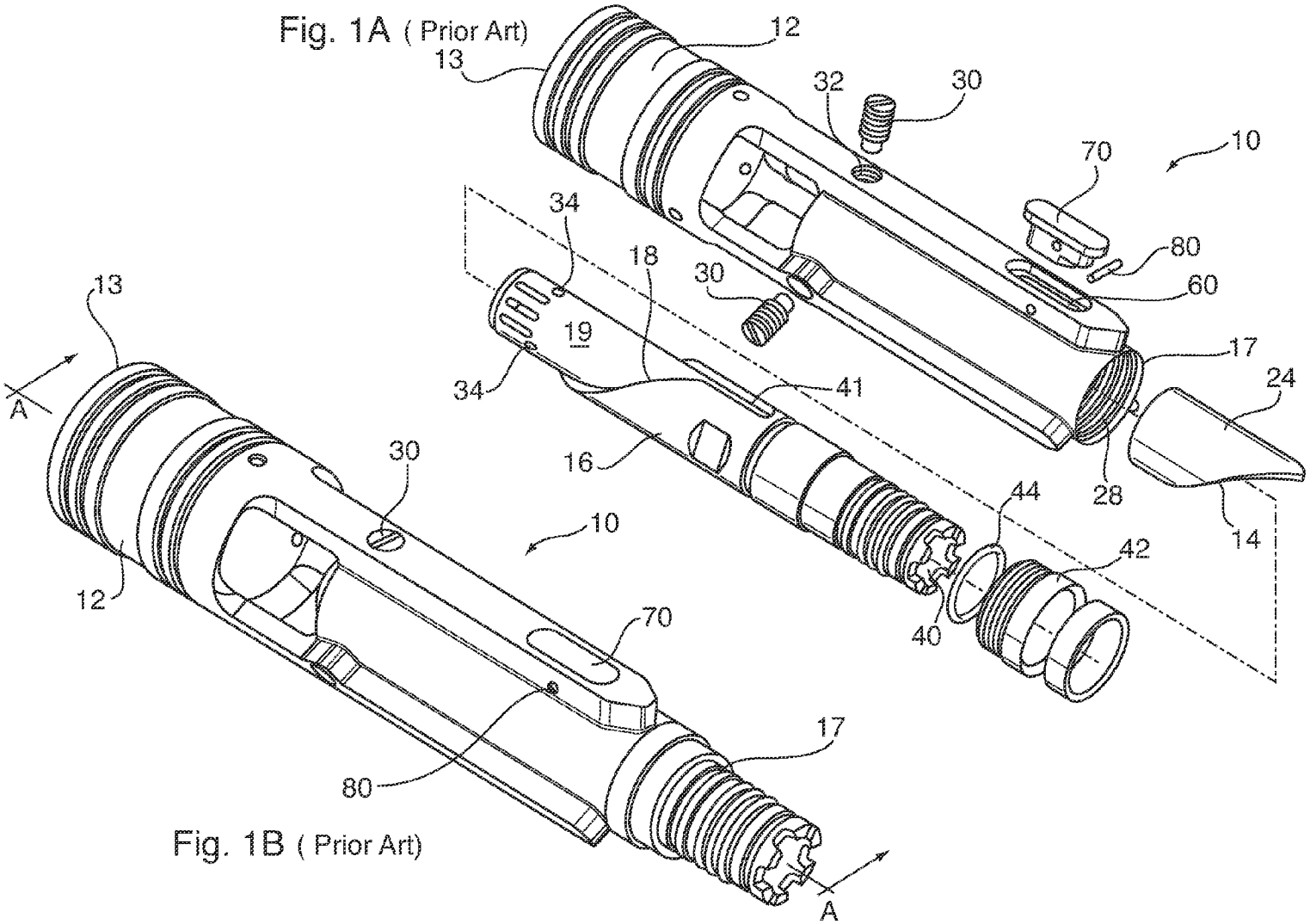
Fig. 1A ( Prior Art)
Fig. 1B ( Prior Art)
FIG. 1A is an exploded perspective view of a mule shoe assembly of the prior art, which uses a threaded set screw to lockably (non-releasably) secure an inner tool to an outer mule shoe.
FIG. 1B is a non-exploded view of the prior art mule shoe assembly of FIG. 1A.
Figure 2:
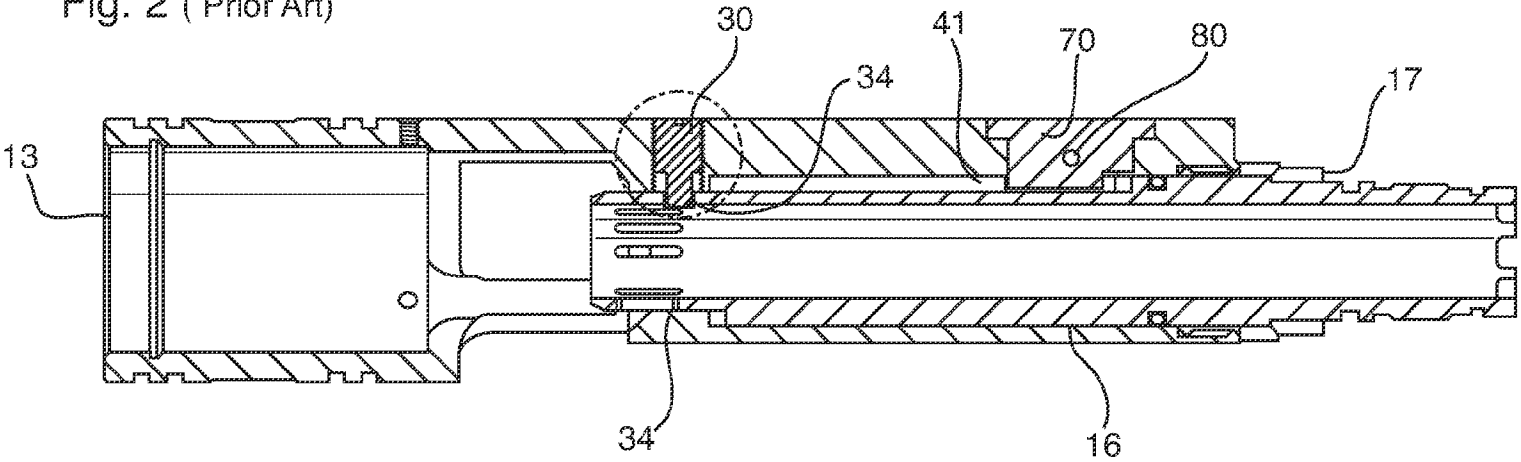
Fig. 2 ( Prior Art)
FIG. 2 is cross-sectional view through the prior art mule shoe assembly of FIG. 1B along section A-A thereof.
Figure 3:
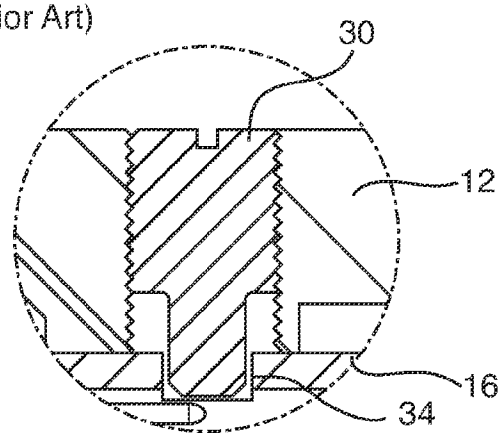
Fig. 3 ( Prior Art)
FIG. 3 is enlarged view of encircled area "B" of FIG. 2.

FIGS. 1A, 1B, 2, & 3 show various views of a mule shoe assembly 10 of the prior art.

Mule shoe assemblies 10 of the prior art typically comprise a substantially cylindrical mule shoe member 12, which contains a hollow bore 28. Mule shoe 12 is adapted at a downhole end 13 thereof to be threadably coupled to a mud motor and associated drill bit (not shown), and at an uphole end 17 thereof adapted to be secured to additional BHA components, such as a mud pulser (not shown).

Mule shoe 12 has a camming member 24, which is insertable within bore 28 and which has an arcuate camming surface 14 thereon. In the prior art, camming member 24 is welded within interior bore 28 of mule shoe 12, in a desired location and angular orientation.

An inner cylindrical tool member 16 is adapted to be inserted within mule shoe 12, as shown in FIGS. 1A & 1B. Inner tool member 16 is adapted to contain within its bore 40 a directional measurement tool (not shown), and is kept in such bore 40 by threaded sleeve 42 and associated "O" ring 44.

Inner tool member 16 possesses an exterior arcuate camming surface 18 on an outer periphery 19 thereof, which shape is complementary to arcuate camming surface 14, and which is adapted for landed engagement with camming surface 18 upon insertion of inner tool member 16 within outer mule shoe 12.

In prior art mule shoe assembly 10, a plurality of threaded set screws 30 are provided, which are adapted to be threadably inserted within apertures 32 in mule shoe 12. When inner tool 16 is inserted in bore 28 of outer mule shoe 12, such causes mutual engagement of each of arcuate camming surfaces 14 and 18 causing relative rotation of the inner tool member 16 relative to outer mule shoe 12, so that apertures 32 in mule shoe 12 become aligned with, and positioned directly above, respective apertures 34 in inner tool member 16.

Upon mutual alignment of apertures 32 with apertures 34 in inner tool member 16, set screws 30 may further be tightened to thereby extend into apertures 34 in inner tool member 16, thereby fixedly securing inner tool member 16 (with a directional tool inserted within a bore 40 thereof) to outer mule shoe 12.

Typically in the prior art, for further maintaining the angular position of inner tool member 16 to outer mule shoe 12, a channel 41 is further provided on outer periphery 19 thereof. Upon landed engagement of the respective accurate camming surfaces 14, 18, channel 41 becomes aligned with slot 60 in mule shoe 12. A key member 70 is then inserted in slot 60 which simultaneously engages channel 41 in inner tool member 16, thereby preventing any further insertion of inner tool 16 within bore 28 of mule shoe 12 and further preventing any relative angular rotation of inner tool 16 (and directional tool member contained therein) relative to mule shoe 12. Key member 70 may be fixedly secured in slot 60 in mule shoe 12 by means of friction fit pin members 80.

Disadvantageously, as explained above, with commencement of drilling, should the drill bit become stuck in a wellbore, due to set screws 30 fixedly securing inner tool 16 and the directional measurement tool therein to mule shoe 12, it is impossible when such mule shoe assembly is downhole to separate the inner tool 16 and the directional measurement tool from the outer mule shoe 12, which remains fixedly secured to the mud motor and drill bit. Accordingly, such mule shoe assembly, including the inner tool member 16 and directional orienting tool therewithin, as well as typically other uphole BHA components, will be lost upon forceable removal of the drill string, which typically separates further uphole from the BHA assembly.

As well, the welding of camming member 24 to interior bore 28 of mule shoe 12 is awkward, to provide camming surface 14 within mule shoe 12 is time consuming, and difficult.

Accordingly, in a broad aspect of the present invention, a mule shoe assembly 100 is provided as shown in FIGS. 4-19 inclusive, which releasably secures the inner tool 160 and associated directional measurement and/or orienting tool to the outer mule shoe 120. Advantageously, in the event a drill bit becomes stuck downhole, the inner tool 160 and associated directional measurement tool may be separated from the outer mule shoe 120 and thereby recovered to surface.

In a first embodiment of the improved mule shoe assembly 100 of the present invention shown in FIGS. 4-7, a cylindrical mule shoe member 120 is provided, which contains a hollow bore 280. Mule shoe 120 is adapted at a downhole end 130 thereof to be threadably coupled to a mud motor and associated drill bit (not shown), and at an upstream end 170 thereof adapted to be secured to additional BHA components, such as a mud pulser (not shown).

Mule shoe 120 has a camming member 240, which is insertable within bore 280 and which has an arcuate camming surface 140 thereon. Friction-fit dowel members 200, each adapted for friction fit within respective apertures 220 in camming member 240, are provided so as to make it possible for camming member 240 to be fixedly coupled to bore 280 of mule shoe 120 without time-consuming welding. Due to dowel member 200 and associated pre-drilled apertures 220, the positioning of camming member 240 within bore 280 is already pre-determined, thus saving time in positioning and securing such camming member 240 within bore 280. Alternatively, as will now occur to persons of skill in the art, instead of friction-fit dowel pin members 200, threaded screws (not shown) may alternatively be used instead of friction fit dowel pins 200. Alternatively, or other similar pinning members employed, such as flush mounted rivets (not shown).

Figure 4:
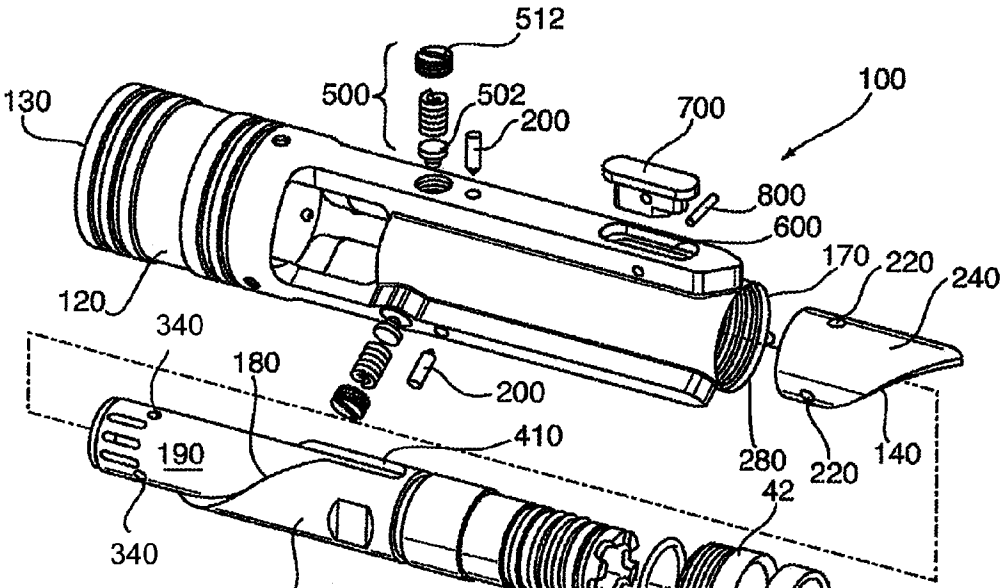
FIG. 4 is an exploded perspective view of a first embodiment of a mule shoe assembly of the present invention, which uses a spring and a detent member to lockably and releasably secure the inner tool to the outer mule shoe.
Figure 5:
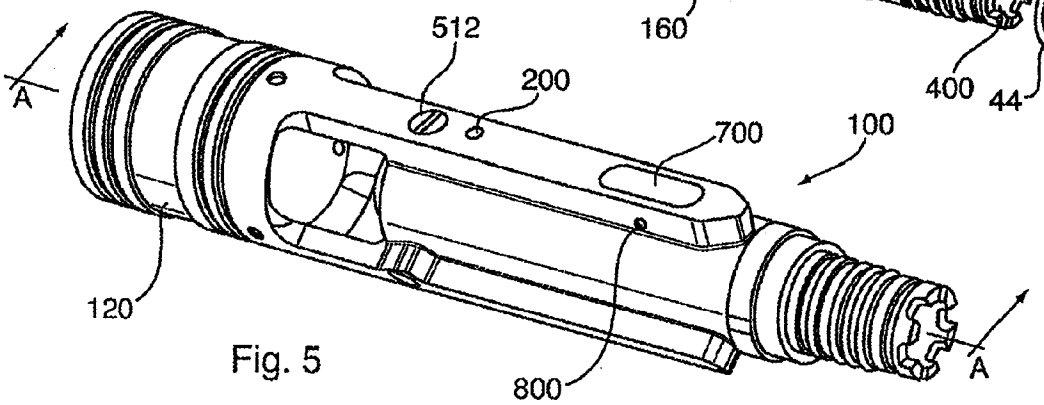
FIG. 5 is a non-exploded view of the mule shoe assembly of FIG. 4.
Figure 6:
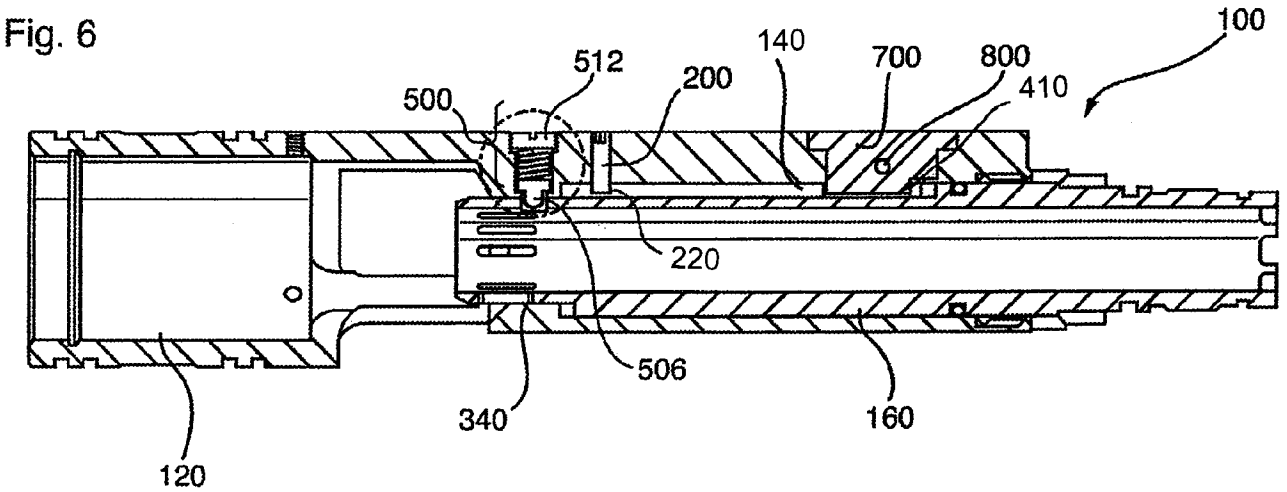
FIG. 6 is cross-sectional view through the mule shoe assembly of FIG. 5, along section A-A thereof.

An inner cylindrical tool member 160 is adapted to be inserted within mule shoe 120, as shown in FIGS. 4 and 5. Inner tool member 160 is adapted to contain within its bore 400 a directional measurement tool (not shown), and is kept in such bore 400 by threaded sleeve 42 and associated "O" ring 44.

Inner tool member 160 possesses an exterior arcuate camming surface 180 on an outer periphery 190 thereof, which shape is complementary to arcuate camming surface 140, and which is adapted for landed engagement with camming surface 180 upon insertion of inner tool member 160 within outer mule shoe 120.

Figure 7:
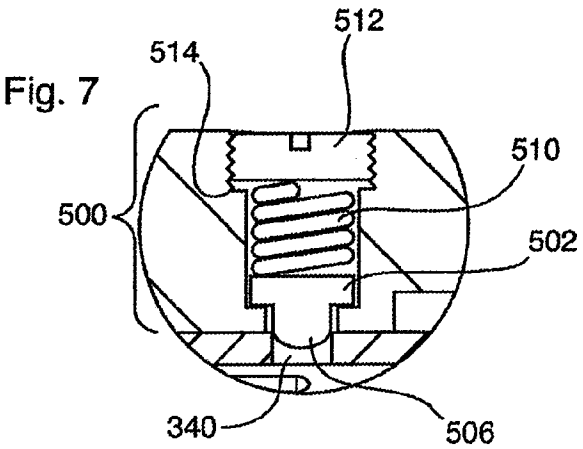
FIG. 7 is enlarged view of encircled area "B" of FIG. 6.
Figure 8:
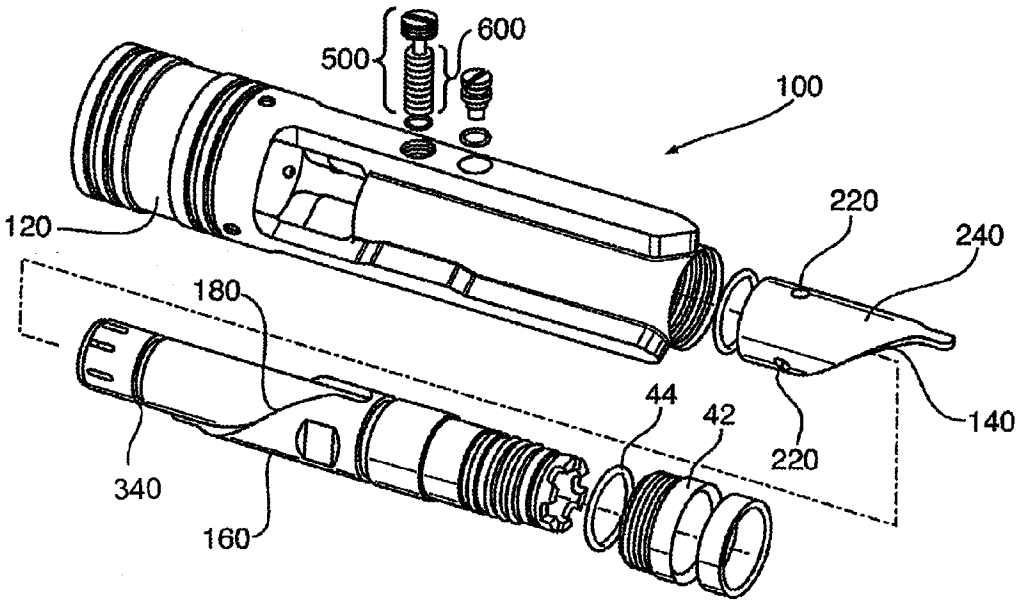
FIG. 8 is an exploded perspective view of a further embodiment of a mule shoe assembly of the present invention, which uses a modified spring and a detent member to lockably and releasably secure the inner tool to the outer mule shoe.
Figure 9:
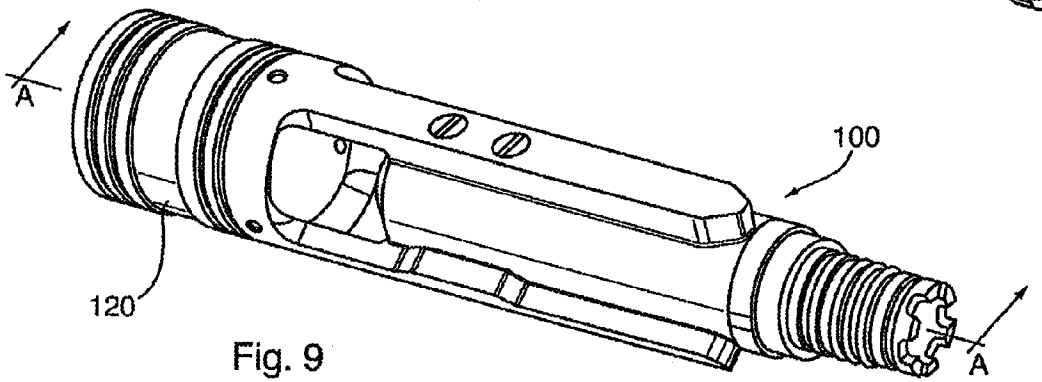
FIG. 9 is a non-exploded view of the mule shoe assembly of FIG. 8.

Advantageously, instead of the set screws 30 being provided as in the case of the prior art mule shoe assemblies 10 shown in FIG. 1A, 1B, one or more novel locking pin members 500 are provided, as shown in FIGS. 4-7. Specifically, in such first embodiment, as best seen in FIG. 4 and FIG. 7, a detent member 502, having a hemispherical end portion 506 adapted for mating engagement with apertures 340, are provided. Accordingly, when inner tool member 160 is inserted within bore 280 of mule shoe 120, and arcuate camming surfaces 140, 180 become landed and the inner tool 160 caused to rotate relative to mule shoe 120, apertures 340 become aligned with pin members 500, and hemispherical end portions 506 may matingly engage apertures 340, thereby releasably securing inner tool 160 to mule shoe 120.

Specifically, to ensure mating engagement of respective hemispherical portions 506 with respective apertures 340, a linear spring member 510 may be provided, as best seen in FIG. 7. Spring member 510 biases hemispherical portion 506 of detent member 502 into mating engagement with aperture 340. A threaded retention screw 512 is further threadably inserted in threaded orifice 514 in outer mule shoe 120, to retain spring 510 is a biased state where hemispherical portion 506 is biased in mating engagement with aperture 340.

In such manner, in accordance with the above configuration, inner tool member 160 may thereafter be releasably separated from mule shoe 120 upon sufficient separating force being applied to inner tool 160 to cause hemispherical portion 506 to cause it to move upwardly and outwardly from aperture 340, thereby allowing detent member 502 to become disengaged from aperture 340, and thus inner tool member 160 thereby permitted to become removed from mule shoe 120.

In a preferred embodiment hemispherical portion 506 of detent 502 is heat treated to a lesser Rockwell hardness than that of aperture 340 in inner tool member 160, so that detent 502 wears sooner than aperture 340 in inner tool member 160.

If desired, for further maintaining the angular position of inner tool member 160 relative to outer mule shoe 120, a channel 410 may be further provided on outer periphery 190 of inner tool member 160. Upon insertion of inner tool 160 into bore 280 of mule shoe 120 and resultant landed engagement of the respective accurate camming surfaces 140, 180, channel 410 becomes aligned with slot 600 in mule shoe 120. Key member 700 may then be inserted in slot 600 so as to engage channel 410 in inner tool member 160, thereby preventing any further insertion of inner tool 160 within bore 280 of mule shoe 120, and further preventing any relative angular rotation of inner tool 160 (and directional tool member contained therein) relative to mule shoe 120. Key member 700 may be fixedly secured in slot 60 in mule shoe 120 by means of friction fit pin members 800. Notably, however, due to channel 410 being open at an end thereof proximate camming surface 180, inner tool 160 may be withdrawn from mule shoe 120 without interference from key member 700 and without having to remove key member 120.

A further embodiment of the mule shoe assembly 100 and locking pin members 500 of the present invention is shown in FIGS. 8-15. Such second embodiment operates identically to the first embodiment except as noted below.

Figures 10, 11, 12, 13, 14, 15:
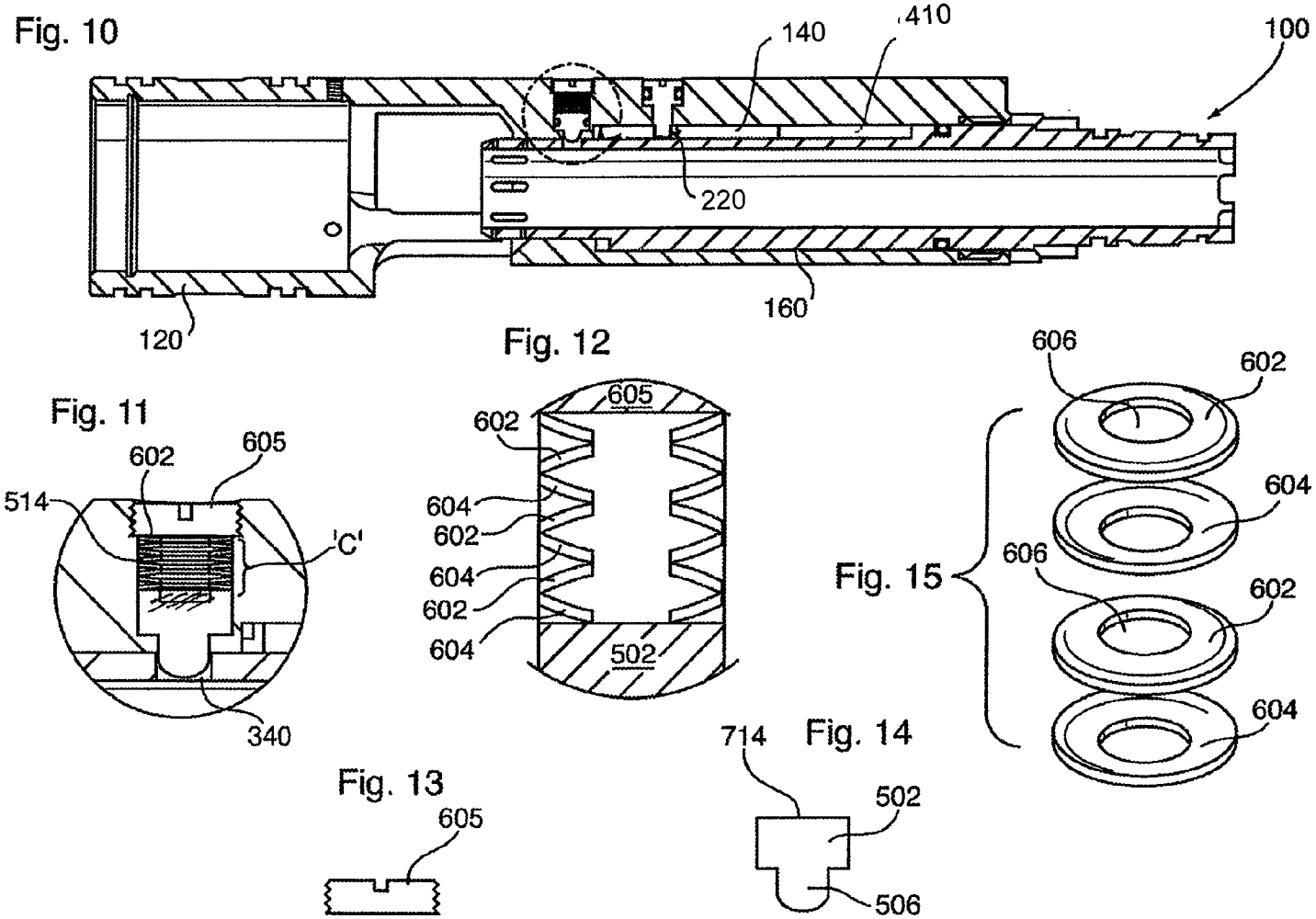
FIG. 10 is cross-sectional view through the mule shoe assembly of FIG. 9, along section A-A thereof.
FIG. 11 is enlarged view of encircled area "B" of FIG. 10.
FIG. 12 is an enlarged view of encircled area "C" of FIG. 11.
FIG. 13 is a view of the threaded retention nut of FIG. 11.
FIG. 14 is a view of the detent member of FIG. 11.
FIG. 15 is a detailed perspective view of the thin curved cylindrical spring members of FIG. 11, shown spaced apart for clarity.

As best shown in FIG. 8 and FIGS. 10-12, a modified spring 600 is utilized in place of spring 510, such spring 600 comprising pairs of respectively convex curved "washer" like elements 602 and concave washer elements 604, in a "Belleville disk" arrangement wherein each of convex/concave washer elements 602, 604 are placed in respective mutually juxtaposed position with each other, as shown in FIGS. 11 & 12. Washer elements 602, 604 may have an optional cylindrical aperture 606 therein, and may be of the type provided by Gardner Spring Co, of Tulsa, Okla., part no. MB0500-025-S, and may be stacked as shown in FIG. 12, or may each be doubled so as to effectively provide double the spring force on detent member 502, if desired. In all cases, however, washer elements 602, 604 function as modified spring 600 when biased into compression by threaded set screw 605 when set screw is threaded into orifice 514 in outer mule shoe 120, and serves to bias detent member 502 in mating engagement with aperture 340.

In operation, similar to the operation of the first embodiment, locking pin member 500, comprising detent member 502, washer spring members 602, 604, and threaded set screw 604 are placed in juxtaposed position as shown in FIGS. 11 & 12, and inserted within orifice 514 in outer mule shoe 120, and set screw turned so as to engage threads 700 on outer mule shoe 120, and thereby apply force against spring members 602, 604, thereby compressing them so that they in turn apply a biasing force against detent member 502, forcing same into aperture 340 in inner tool 160, thereby retaining same in bore 480 of outer mule show 120. When desired, such as in a situation when a drill bit becomes lodged downhole, inner tool member 160 may be releasably separated from mule shoe 120 upon sufficient separating force being applied to inner tool 160 to cause hemispherical portion 506 of detent member 502 to move upwardly and outwardly from aperture 340, thereby allowing detent member 502 to become disengaged from aperture 340, and thus allow inner tool member 160 to be removed from bore 480 of mule shoe 120.

Figure 16:
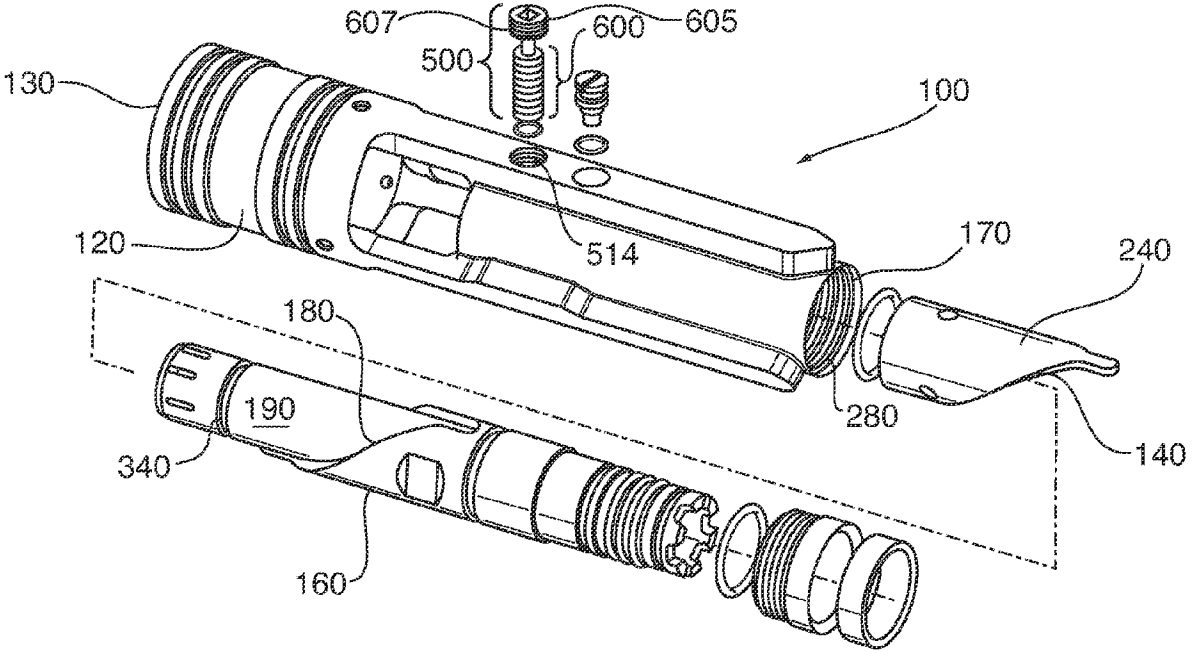
FIG. 16 is an exploded perspective view of the second preferred embodiment of a mule shoe assembly of the present invention, which uses both a modified spring and a detent member to lockably and releasably secure the inner tool to the outer mule shoe.
Figure 17:
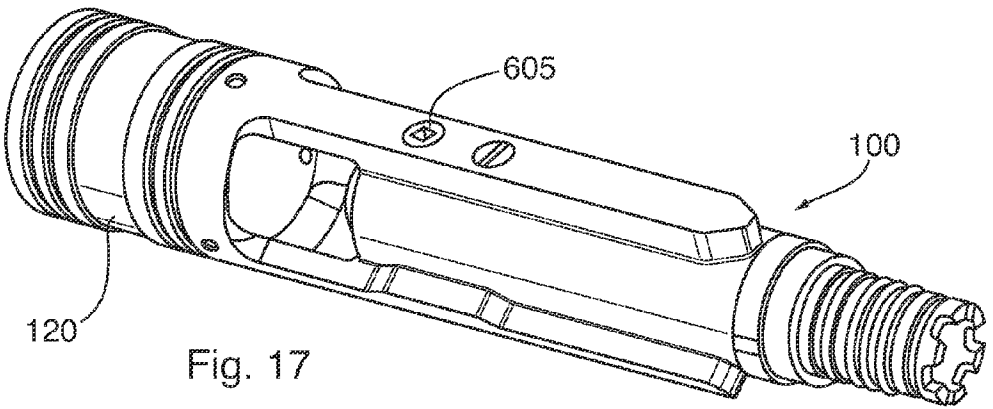
FIG. 17 is a non-exploded view of the mule shoe assembly of FIG. 16.
Figure 18:
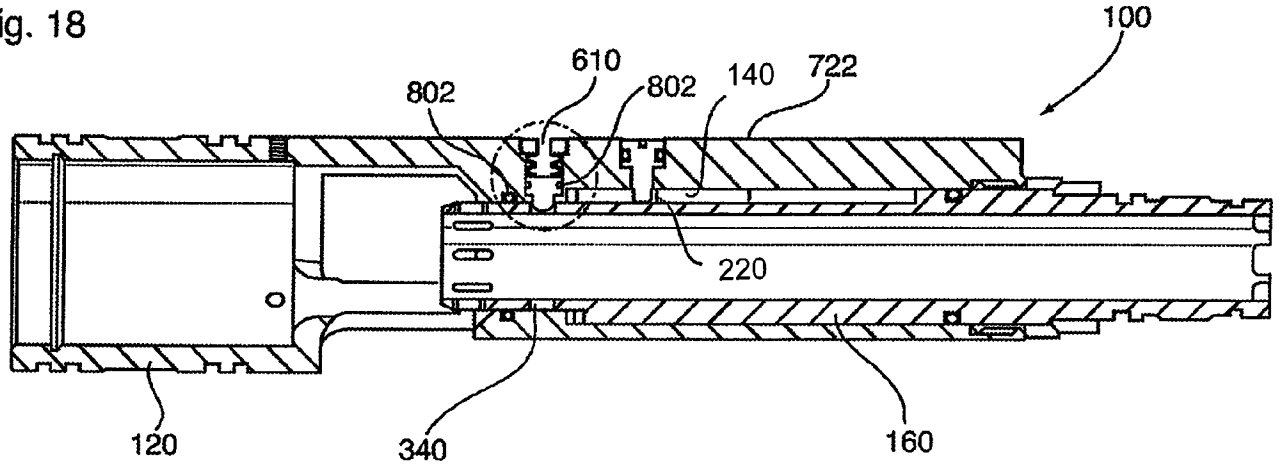
FIG. 18 is cross-sectional view through the mule shoe assembly of FIG. 17, along section A-A thereof.
Figure 19:
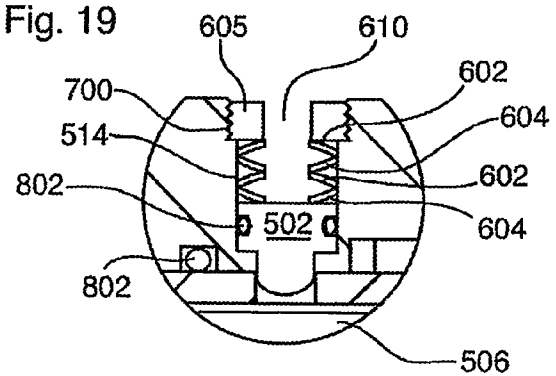
FIG. 19 is enlarged view of encircled area "B" of FIG. 18.

A second embodiment of the mule shoe assembly 100 and locking pin members 500 of the present invention is shown in FIGS. 16-20. Such third embodiment is preferable to that of the first and second embodiments, and operates identically to the second embodiment except as noted below. As best shown in FIG. 16 and FIGS. 18 & 19, a modified spring 600 is utilized, comprising pairs of respectively convex curved "washer" like elements 602 and concave washer elements 604. Each of washer elements 602, 604 is provided with a cylindrical aperture 606 therein to drilling mud pressure may be supplied to upper surface 714 of detent member 502. Washer elements 602, 604 may be of the type provided by Gardner Spring Co, of Tulsa, Okla., part no. MB0500-025-S. Washer elements 602, 604, when biased into compression by threaded set screw 604, serve to bias detent member 502 in mating engagement with apertures 340 in outer mule shoe 120.

Figure 20:
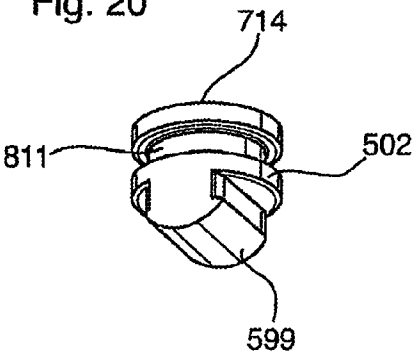
FIG. 20 is a detailed bottom perspective view of the detent member shown in FIG. 19.

Importantly in this embodiment, set screw 605 having external threads 607, has an aperture 610 therein which may be hexagonal in shape to allow insertion of an allen key to allow tightening of such set screw 605 within orifice 514 in outer mule shoe 120. Aperture 610 allows drilling mud pressure to be exerted on upper surface 714 of detent member 502, thereby (along with washer elements 602,604) biasing such detent member 502 downwardly and into aperture 340 when such apertures 340 become aligned with orifice 514 upon landing of the arcuate camming surfaces 140, 180. Detent member 502 may possess a hemispherical end portion 506, or simply an arcuate rounded portion 599, as shown in FIG. 20.

'O' rings 802 are provided in inner tool member 160, and optionally in groove 811 in detent member 502, to ensure a pressure differential exists between an exterior surface 722 of mule shoe 120, and aperture 340 in inner tool 160.

In operation, similar to the operation of the first and further embodiments, locking pin member 500, comprising detent member 502, washer spring members 602, 604, and threaded set screw 605 are placed in juxtaposed position as shown in FIG. 19, and inserted within orifice 514 in outer mule shoe 120, and set screw 605 turned using an allen key inserted in hexagonal aperture 610 so as to engage threads 514 on outer mule shoe 120, and thereby applying force against spring members 602, 604, thereby compressing them so that they in turn apply a biasing force against detent member 502, forcing same into aperture 340 in inner tool 160, thereby retaining same in bore 280 of outer mule show 120. When mule shoe assembly 100 is placed downhole, drilling mud pressure on exterior surface 722 exerts a further pressure on detent member 502, further biasing detent member 502 into engagement with aperture/slot 340.

In a situation when a drill bit becomes lodged downhole, drilling mud pressure being supplied downhole to a mud motor is stopped, and pressure is thereby removed from upper surface 714 of detent member 502. Inner tool member 160 may then be releasably separated from mule shoe 120 upon sufficient separating force being applied to inner tool 160 to cause rounded portion 599 of detent member 502 to move upwardly and outwardly from aperture 340, thereby allowing detent member 502 to become disengaged from aperture 340, and thus allow inner tool member 160 to be removed from bore 480 of mule shoe 120.

Figure 21:
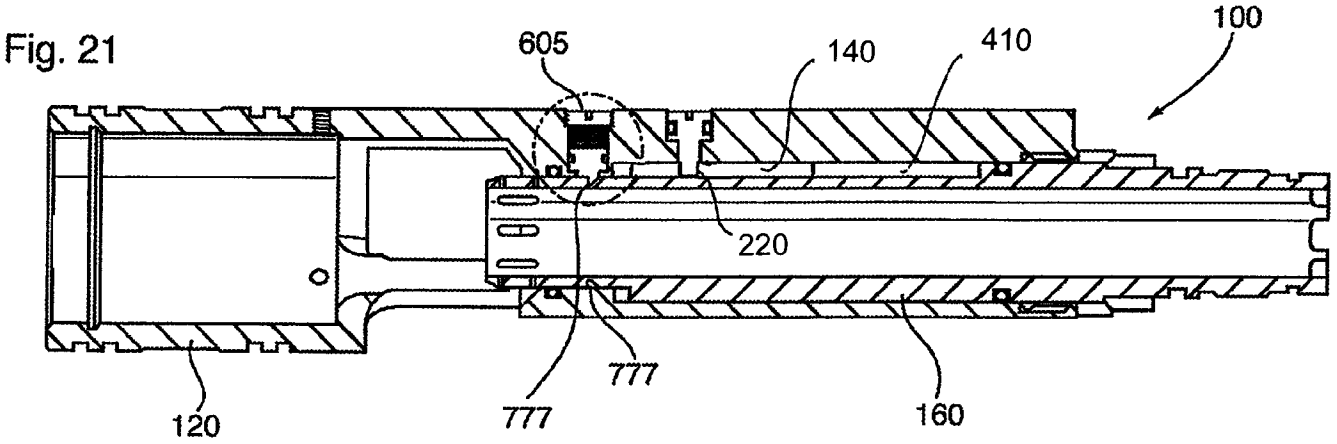
FIG. 21 is a cross-sectional view through the mule shoe assembly, showing another embodiment of the detent member.
Figure 23:
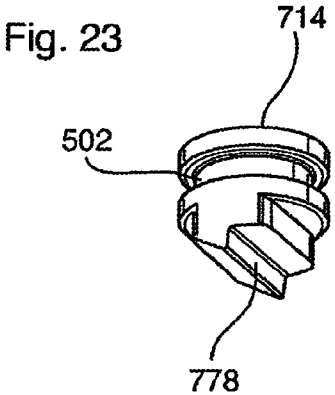
FIG. 23 is a detailed bottom perspective view of the detent member shown in FIG. 22.
Figure 22:
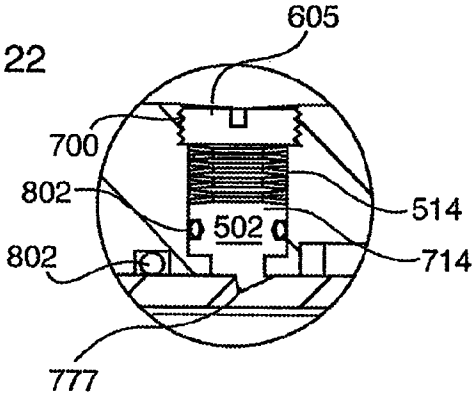
FIG. 22 is enlarged view of encircled area "B" of FIG. 21.

In a fourth embodiment shown in FIGS. 21-23, the locking pin member 500 is configured and functions similar to the second embodiment, save and except for different configuration and operation of detent member 502 forming part of locking member 500. Specifically, detent member 502 does not possess a hemispherical portion or rounded portion, but instead possess a milled slot portion 778 for lockingly engaging a mating slot 777 on inner tool member 120. Importantly, detent member 502, or at least such milled slot portion 778 thereof, is of a metal which has considerably weaker shear strength than that of mating slot 777 of inner tool member 120, or of mule shoe 120 in the region of aperture 514 therein, and is adapted to be sheared upon application of sufficient shear stress to such component.

In operation, similar to the operation of the second embodiment, locking pin member 500, comprising detent member 502, washer spring members 602, 604, and threaded set screw 605 are placed in juxtaposed position as shown in FIG. 22, and inserted within orifice 514 in outer mule shoe 120, and set screw 605 turned so as to engage threads 514 on outer mule shoe 120, and thereby applying force against spring members 602, 604, thereby compressing them so that they in turn apply a biasing force against detent member 502, forcing same into aperture 340 in inner tool 160, thereby retaining same in bore 280 of outer mule shoe 120. However, for desired removal of inner tool member 160, such may be releasably separated from mule shoe 120 upon sufficient separating force being applied to inner tool 160 to cause milled slot 778 of detent member 502, being of a weaker material than mule shoe 120 and inner tool member 160, to shear, thereby allowing detent member 502 to become disengaged from aperture/slot 340, and thus allowing inner tool member 160 to be removed from bore 280 of mule shoe 120.

The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. A releasably lockable retrievable mule shoe assembly for use in a bottom hole orienting assembly of a drill string in directional drilling of a well, comprising:

(i) a substantially cylindrical hollow elongate outer mule shoe member, having:

(a) an arcuate camming surface around an inner periphery of said outer mule shoe member;

(ii) an inner cylindrical tool member, containing a directional measurement tool, and adapted for insertion within said outer mule shoe member, having:

(a) a mating arcuate camming surface adapted for mating engagement with said camming surface on said outer mule shoe member;

(iii) a linearly slidably moveable locking pin member, for releasable locking engagement between the outer mule shoe member and the inner cylindrical tool member and/or the directional measurement tool and configured to allow disengagement downhole of said outer mule shoe member from said inner cylindrical tool member and/or directional measurement tool and withdrawal of said directional measurement tool from within said outer mule shoe member when said outer mule shoe member is lodged downhole in the well;

(iv) aperture means in each of said inner cylindrical tool member, and said outer mule shoe member, extending perpendicular to a longitudinal axis of said outer mule shoe member and through said outer mule shoe member, for slidably receiving therewithin said locking pin member;

(v) said locking pin member being located in said aperture means in said outer mule shoe member, and further slidably moveable into said aperture means in said inner cylindrical tool member, for releasably coupling said outer mule shoe member to said inner cylindrical tool member when said inner cylindrical tool member is inserted in said outer mule shoe member.

2. The releasably lockable retrievable mule shoe assembly as claimed in claim 1, wherein said locking pin member is slidably moveable in a linear back and forth direction perpendicular to a longitudinal axis of said outer mule shoe member.

3. The releasably lockable retrievable mule shoe assembly as claimed in claim 2, wherein said locking pin member comprises a slidably moveable detent member radially inwardly biased into releasable engagement with said aperture means in said inner cylindrical tool member.

4. The releasably lockable retrievable mule shoe assembly as claimed in claim 2, wherein said locking pin member further comprises:

a) spring means;

b) a detent member, resiliently-biased by said spring means;

said spring means resiliently biasing said detent member to releasably engage said aperture means in said inner cylindrical tool member and adapted to disengage said aperture means in said inner cylindrical tool member when an upward force is applied to said drill string to thereby allow said directional measurement tool to thereafter be drawn uphole and thereby recovered.

5. The releasably lockable retrievable mule shoe assembly as claimed in claim 4, wherein said detent member is adapted, when said assembly is placed downhole in said well and downhole fluid pressure is exerted on an exterior surface thereof, to lockingly couple said outer mule shoe member to said inner cylindrical tool member, and when said downhole fluid pressure is lessened or removed and an upward force is applied to said drill string, is further adapted to disengage said inner cylindrical tool member to allow said inner cylindrical tool member and said directional measurement tool to be withdrawn from within said outer mule shoe member.

6. The releasably lockable retrievable mule shoe assembly as claimed in claim 2, wherein said locking pin member is adapted, when said mule shoe assembly is placed downhole in the well and downhole fluid pressure is exerted on an exterior surface thereof, to lockingly maintain in coupled engagement said outer mule shoe member to said inner cylindrical tool member, and when said downhole fluid pressure is lessened or removed, and when a separating force is applied between said outer mule shoe member and said inner cylindrical tool member is further adapted to disengage said inner cylindrical tool member to allow said inner cylindrical tool member and said directional measurement tool to be withdrawn from within said outer mule shoe member.

7. The releasably lockable retrievable mule shoe assembly as claimed in claim 2, wherein said aperture means is further located in said directional tool member, and said locking pin member further comprises:

a) spring means;

b) a detent member resiliently-biased by said spring means, wherein said spring means resiliently biases said detent member so as to cause said detent member to releasably engage aperture means in said directional tool member.

8. The releasably lockable retrievable mule shoe assembly as claimed in claim 1, wherein said locking pin member is shearable.

9. The releasably lockable retrievable mule shoe assembly as claimed in claim 8, wherein said locking pin member is adapted, upon an upward separation force greater than the weight of the drill string below said mule shoe assembly being applied to said inner cylindrical tool member and said outer mule shoe member, to become sheared off so as to allow separation of said inner cylindrical tool member from said outer mule shoe member.

10. The releasably lockable retrievable mule shoe assembly as claimed in claim 1, wherein said mule shoe assembly further comprises:

(vi) a channel within an exterior periphery of said inner directional tool member;

(vii) a key member, for insertion through an orifice in said outer mule shoe member and into said channel when said camming surfaces have engaged each other and angularly positioned said directional tool to a desired angular position relative to said outer mule shoe member, so as to maintain said outer mule shoe member and said inner tool member in said desired angular position relative to each other.

11. The releasably lockable retrievable mule shoe assembly as claimed in claim 1, wherein said aperture means in said inner cylindrical tool member is located in said directional tool, and said locking pin member is received therein to releasably lockingly engage said inner cylindrical tool member to said outer mule shoe member.

12. The releasibly lockable retrievable mule shoe assembly as claimed in claim 1, wherein said arcuate camming surface around said inner periphery of said mule shoe member is fixedly secured to said inner periphery via pin members.

13. A universal bottom hole orientation (UBHO) sub for containing a directional orientation measurement tool for use in a drill string for directional drilling of a well, comprising:

(i) a substantially cylindrical hollow elongate outer mule shoe member, having:

(a) an arcuate camming surface around an inner periphery of said outer mule shoe member;

(ii) an inner cylindrical tool member, containing said directional measurement tool, and adapted for insertion within said outer mule shoe member, having:

(a) a mating arcuate camming surface adapted for mating engagement with said camming surface on said outer mule shoe member;

(iii) a locking pin member, possessing a linearly slidably moveable resiliently-biased detent member, said detent member providing releasable locking engagement between the outer mule shoe member and the inner cylindrical tool member and/or the directional measurement tool;

(iv) an aperture means in each of said inner cylindrical tool member and said outer mule shoe member and extending through said outer mule shoe member, for receiving therewithin said locking pin member, said locking pin member slidably moveable in said aperture means in said outer mule shoe member; and (v) said detent member moveable in a linear back and forth direction perpendicular to a longitudinal axis of said outer mule shoe member, and located in said aperture means in said outer mule shoe member, and further slidably moveable in said aperature means in said inner cylindrical tool member, for releasably coupling said outer mule shoe member to said inner cylindrical tool member when said inner cylindrical tool member is inserted in said outer mule shoe member.

14. The universal bottom hole orientation (UBHO) sub for containing a directional orientation measurement tool for use in directional drilling of wells as claimed in claim 13, wherein detent member is, located within said aperture means in said outer mule shoe member and is radially inwardly biased so as to further matingly engage said aperture means in said inner cylindrical directional tool member.

15. The universal bottom hole orientation (UBHO) sub for containing a directional orientation measurement tool for use in a drill string for directional drilling of a well as claimed in claim 13, wherein said locking pin member further comprises:

a) spring means; and b) said detent member is resiliently-biased by said spring means;

wherein said spring means is adapted to cause said detent member to releasably engage said aperture means in said inner cylindrical tool when said aperture means is further located in said directional measurement tool.

16. The universal bottom hole orientation (UBHO) sub for containing a directional orientation measurement tool for use in a drill string for directional drilling of a well as claimed in claim 15, wherein said detent member is adapted, when said assembly is placed downhole in a well and downhole fluid pressure is exerted on an exterior surface thereof, to lockingly engage said mule shoe member to said directional measurement tool, and when said downhole fluid pressure is lessened or removed, is further adapted disengage said directional measurement tool to allow said inner cylindrical directional tool member and said directional measurement tool to be withdrawn from within said outer mule shoe member.

17. The universal bottom hole orientation (UBHO) sub for containing a directional orientation measurement tool for use in a drill string for directional drilling of a well as claimed in claim 13, wherein said detent member is adapted, when said assembly is placed downhole in a well and downhole fluid pressure is exerted on an exterior surface thereof, to slidably engage said aperture means in said inner cylindrical tool member and lockingly couple said mule shoe member to said directional measurement tool, and when said downhole fluid pressure is lessened or removed, is further adapted upon an upward force being applied to said drill string to disengage said aperture means in said inner cylindrical tool member and thereby allow said inner cylindrical tool member and said directional tool to be withdrawn from within said outer mule shoe member.

18. The universal bottom hole orientation (UBHO) sub for containing a directional orientation measurement tool for use in a drill string for directional drilling of a well as claimed in claim 13, further comprising:

(vi) a channel within an exterior periphery of said inner cylindrical tool member;

(vii) a key member, for insertion through an orifice in said outer mule shoe member and into said channel when said camming surfaces of said outer mule shoe member and said inner cylindrical tool member are engaged so as to maintain said outer mule shoe member and said inner cylindrical tool member containing said directional measurement tool in fixed angular relationship to each other.

* * * * *